United States Patent [19]

Milberger

[11] 4,378,848

[45] Apr. 5, 1983

[54] METHOD AND APPARATUS FOR CONTROLLING SUBSEA WELL TEMPLATE PRODUCTION SYSTEMS

[75] Inventor: Lionel J. Milberger, Spring, Tex.

[73] Assignee: FMC Corporation, Chicago, Ill.

[21] Appl. No.: 191,046

[22] Filed: Sep. 25, 1980

[30] Foreign Application Priority Data

Oct. 2, 1979 [GB] United Kingdom ..... 7934106

[51] Int. Cl.[3] ..... E21B 34/04; E21B 43/017

[52] U.S. Cl. ..... 166/362; 166/367; 166/366; 166/368

[58] Field of Search ..... 166/362, 366, 368, 72, 166/375, 367; 137/236 S

[56] References Cited

U.S. PATENT DOCUMENTS

| | | | |
|---|---|---|---|
| 3,261,398 | 7/1966 | Haeber | 166/368 |
| 3,516,491 | 6/1970 | Lewis . | |
| 3,612,177 | 10/1971 | Gassett et al. . | |
| 3,612,177 | 10/1971 | Knizrer et al. | 166/366 |
| 3,633,667 | 1/1972 | Falkner | 166/366 |
| 3,865,142 | 2/1975 | Begun | 137/236 S |
| 3,921,500 | 11/1975 | Silcox . | |
| 4,027,286 | 5/1977 | Marosko . | |
| 4,174,000 | 11/1979 | Milberger | 166/368 |
| 4,185,541 | 1/1980 | Milberger et al. . | |

FOREIGN PATENT DOCUMENTS

| | | |
|---|---|---|
| 2371552 | 6/1978 | France . |
| 2385887 | 10/1978 | France . |
| 2399564 | 3/1979 | France . |

*Primary Examiner*—William F. Pate, III

*Attorney, Agent, or Firm*—L. B. Guernsey; W. W. Ritt; R. B. Megley

[57] ABSTRACT

Method and apparatus for remotely controlling subsea template production systems having a plurality of satellite wells and a plurality of subsea trees on the well templates uses a significantly reduced number of electrical and hydraulic lines between a surface control unit and a riser base on the seafloor. An electrohydraulic control module on the riser base receives electrical control signals and provides hydraulic output signals to operate the riser base. Electrohydraulic control modules on the templates receive electrical control signals and provide hydraulic output signals to control operation of the trees on the templates. The satellite wells are each controlled by a single hydraulic signal line connected between the surface control unit and a matrix switching control module at the satellite well. All of the electrohydraulic modules are replaceable using surface operated running tools.

24 Claims, 7 Drawing Figures

F

METHOD AND APPARATUS FOR CONTROLLING SUBSEA WELL TEMPLATE PRODUCTION SYSTEMS

BACKGROUND OF THE INVENTION

1. Field of the Invention

This invention relates to apparatus for remote control of a plurality of subsea devices, and more particularly to apparatus for individual control of a relatively large number of subsea devices using only a few electrical and hydraulic source lines from a surface control unit to the seafloor.

2. Description of the Prior Art

The production of gas and oil from offshore wells has developed into a major endeavor of the petroleum industry. Wells are commonly drilled several hundred or even several thousand feet below the surface of the ocean, substantially below the depth at which divers can work efficiently. The wells are often located in clusters with production lines extending from each of the wells to a production riser base on the seafloor, then upward to an offshore production platform. The operation of the wells must be controlled from the production platform or from a surface vessel. The testing, production and shutting down of each of the subsea wells is regulated by a subsea Christmas tree which is positioned on top of the subsea wellhead. The Christmas tree includes a plurality of valves having operators which are biased to a non-active position by spring returns, and it has been found convenient to actuate these operators by hydraulic fluid which is directly controlled from the production platform. For this purpose, a plurality of hydraulic lines are commonly run from the surface platform to the wellhead to open and close these valves, and to actuate other devices in the well and the wellhead during installation, testing and operating the subsea well equipment, and also during workover procedures being performed on the well.

Some of the more extensive production fields include a plurality of templates each having several wells thereon and a plurality of individual or satellite wells each having a subsea tree mounted atop the well. The wells may be connected to a plurality of flowlines which are coupled to a production platform through a riser base and a production riser. There are numerous valves and connectors on the trees, templates and riser base which must be controlled in an orderly, precise and fail-safe manner. Prior art control systems have used hydraulic control and pressure lines between the production platform and the individual valves and connectors with a conferral line for each valve or connector to be controlled. As systems become larger, the number of these control lines becomes too large to be handled in a multi-hose bundle and costs become unreasonable.

Other prior art control systems include electrohydraulic operators having electrical control lines to the operators which control hydraulic fluid to open and close valves. Such prior art systems have not achieved a high degree of confidence or use because of the large wire connectors required and due to problems in sealing and providing trouble-free electrical connectors.

One prior art control system which uses total hydraulic control for operating a large number of subsea operators using only a few lines between a surface control center and the seafloor has been developed. The system called matrix switching is disclosed in a copending patent application Ser. No. 101,993 filed Dec. 7, 1979, by the inventor of the present invention.

SUMMARY OF THE INVENTION

The present invention overcomes some of the disadvantages of the prior art systems by using a plurality of electrically operated control modules in subsea locations where these electrical modules can be easily replaced, and by using hydraulically operated modules and controls where replacement is difficult and where long life and trouble-free operation is required. The use of electrically controlled modules reduces the size and cost of control lines between a surface control unit and a subsea riser base, and provides reliable control of subsea equipment. The electrical control modules use electrical signals to control a plurality of valves and operators on the riser base and use electrical signals to control the operation of hydraulic valves which are hydraulically coupled to other valves and to operators in remote or inaccessible areas.

DESCRIPTION OF THE PREFERRED EMBODIMENT

Figure 1:
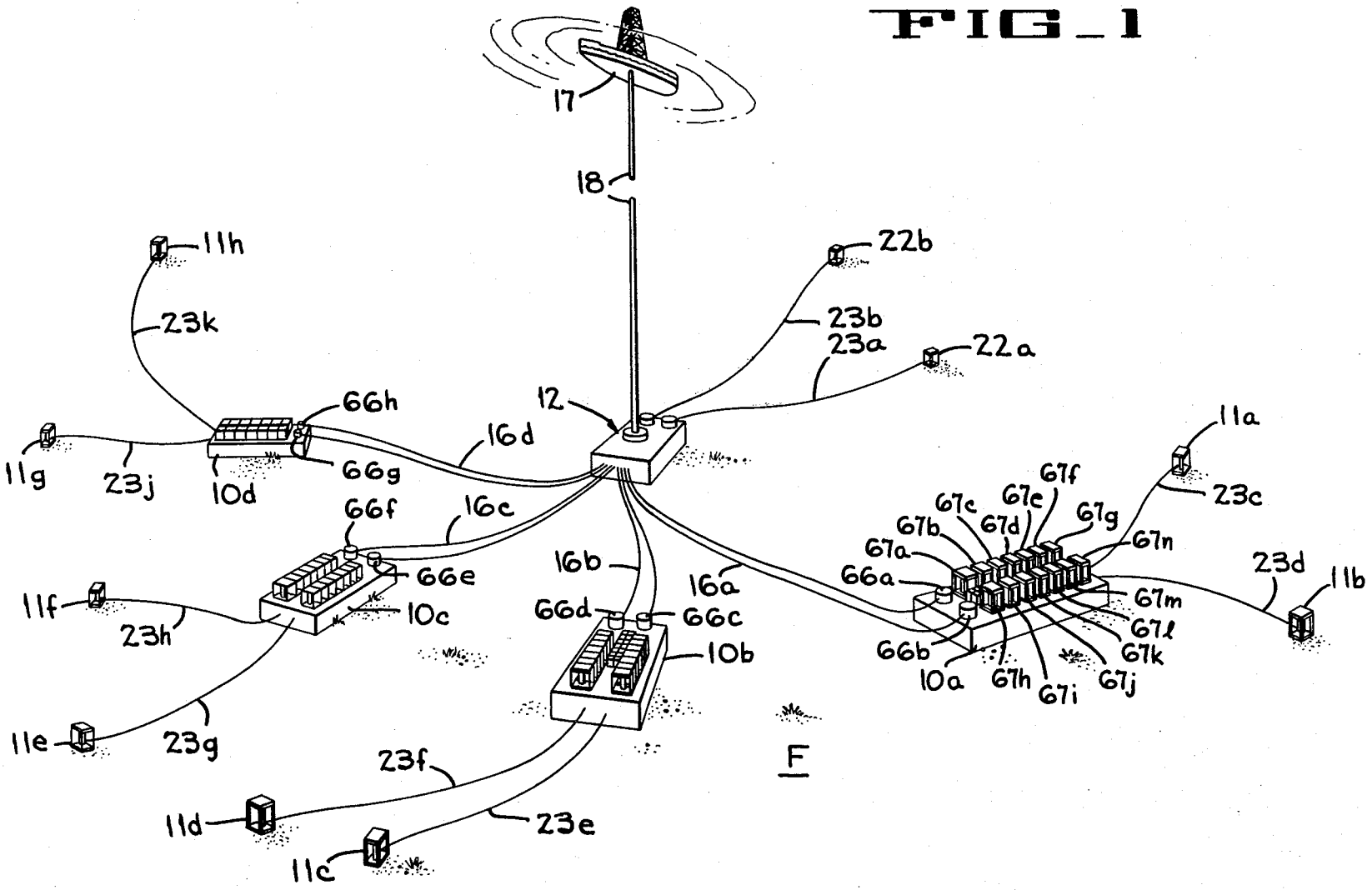
FIG. 1 is a perspective drawing of a subsea well production system in which the apparatus of the present invention is used.
Figure 2:
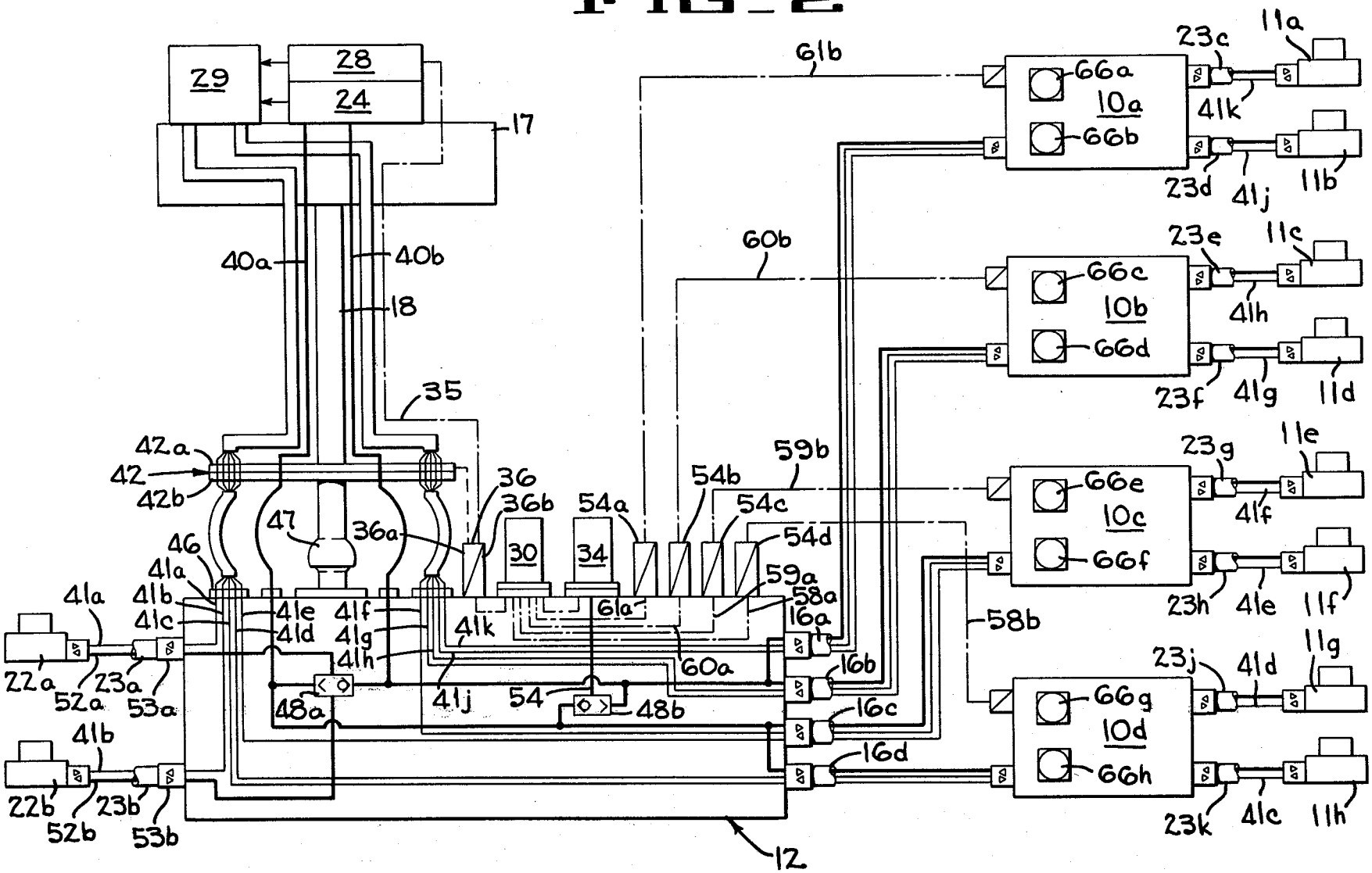
FIG. 2 is a schematic of the electrical and hydraulic control circuitry of the present invention.

Referring now to the drawings, FIGS. 1 and 2 disclose a subsea oil and gas production field having a plurality of subsea templates 10*a*–10*d* mounted on the sea-floor F (FIG. 1) with each of the templates connected to a pair of satellite wells 11*a*–11*h*. The templates are connected to a subsea riser base 12 by a plurality of flowline bundles 16*a*–16*d*. The riser base 12 is connected to a production platform 17 on the water surface by a production riser 18. A pair of satellite wells 22*a*,22*b* are connected directly to the riser base 12 by a pair of flowline bundles 23*a*,23*b*.

The production platform 17 (FIG. 2) includes a hydraulic power unit 24, an electrical power unit 28 and a surface control unit 29 which provide electrical power, electrical control signals, hydraulic power and hydraulic control signals to operate the various portions of the production field. An electrical distribution center 30 and a riser base control module 34, mounted on the riser base 12, utilize multiplexed control signals from the surface control unit 29 to provide power and control signals to the templates 10*a*–10*d* and to the riser base. Electrical power and control signals are provided to the electrical center 30 by an electric cable 35 secured to the outside of the riser 18 and coupled to the electric center 30 by a connector 36. The upper end of the cable 35 is coupled to the electrical power unit 28, which provides power to operate a plurality of electrical devices, and to the surface control unit 29 which controls the application of power to selected devices on the riser base 12 and on the templates 10a–10c. A pair of hydraulic supply lines 40a,40b provide hydraulic power to a large number of hydraulically operated devices on the templates 10a–10d, in the riser base 12, and the satellite wells 11a–11h, 22a,22b. A plurality of hydraulic control lines 41a–41k each provide control signals for a corresponding one of the satellite wells 11a–11h and 22a,22b. The use of multiplexed signals to the distribution center 30 and to the riser base control module 34 greatly reduce the number of hydraulic and electrical lines required between the production platform 17 and the riser base 12. The distribution center 30 and a control module 34 can each be replaced if necessary by using a running tool (not shown) to unplug a defective unit and replace it with a new unit.

The lower end of the riser 18 (FIG. 2) includes an upper connector 42 and a lower connector 46 connected by a flexible joint 47. The riser 18 and an upper portion 42a of the connector 42 can be disconnected from a lower portion 42b and the hydraulic lines 40a,40b, 41a–41k disconnected. An upper portion 36a of the electrical connector 36 is mounted on the portion 42a of the connector and a lower portion 36b is mounted on the riser base 12 so that the electrical cable 35 is also disconnected when the connector 36 is separated. The connector 46 can be separated to remove the flexible joint 47.

Hydraulic power to operate the satellite wells 22a,22b (FIG. 2) is coupled to a pair of hydraulic power lines 52a,52b from the supply lines 40a,40b by a check valve 48a through a pair of connectors 53a,53b. Hydraulic power to operate the numerous hydraulically actuated devices on the riser base is coupled to the riser base control module 34 by a check valve 48b and a hydraulic power line 54. Other control components located on the riser base 12 include a plurality of electrical connectors 54a–54d which connect the electrical lines 58a–61a to the corresponding electrical lines 58b–61b to couple control signals from the distribution center 30 to the templates 10a–10d. The lines 58a–61a, 58b–61b each include a plurality of electrical lines but are shown as single lines to simplify the drawing. The electrical lines provide signals to the individual lines 61c,61d (FIG. 3) which provide control to an electronics portion 65 (FIG. 4) in each of a plurality of electro-hydraulic multiplexed control modules 66a–66h (FIGS. 1–3) which control operation of a plurality of template wells 67a–67n (FIG. 3) on each of the templates 10a–10d. The electronics portion 65 operates a plurality of spool valves 71 (only two are shown in FIG. 4) and the spool valves provide hydraulic control for a plurality of valves 72–79 and a subsea choke 83 in a manifold module 84a–84n and in a Chirstmas tree 85 at each of the wells 67a–67n.

The tree valves 76,77,79 (FIG. 4) are controlled by control module 66a through a plurality of control lines 89a–89c that run through a tree flowline connector 90 and loop through a tree cap 91 to the actuators of the individual tree valves. Thus, when the tree cap 91 is removed, the valves on the Christmas tree 85 cannot be controlled by the control module 66a. However, a running tool or workover tool can be installed atop the tree and various actuators can be controlled through the tool. When the manifold module 84a is removed, the hydraulic supply line 40c no longer provides pressurized hydraulic fluid to the control module 66a and the valves in the Christmas tree cannot be controlled by the module 66a. The hydraulic supply line 40c loops through the flowline connector 90, the tree cap 91, the connector 90 again and through the manifold module 84a to the control module 66a. When the tree cap 91 is removed, or the manifold module 84a or the control module 66a are removed, the hydraulic supply line 40c is interrupted so that the tree valves cannot be inadvertently opened or closed.

Figure 7:
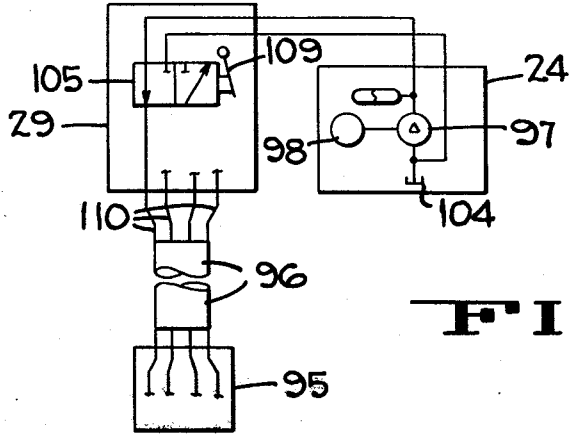
FIG. 7 is a schematic diagram of a workover and installation control system for use with the subsea production system.

A workover control system for operating the various connectors and operators in the Christmas tree when the tree cap is removed as disclosed in FIG. 7 includes a running tool 95 and a control unit 29 interconnected by a hydraulic umbilical bundle 96. Pressurized hydraulic fluid is supplied to the control unit 29 by a hydraulic pump 97 powered by a motor 98 in the hydraulic power unit 24. The pump 97 delivers fluid from a reservoir 104 to a plurality of spool valves 105 (only one shown in FIG. 7) each operated by a pilot 109. A plurality of hydraulic lines 110 in the umbilical bundle 96 provide power to operate an actuator 111 (FIG. 4) in a tree cap connector 115 and to operate the various valves 73–79 in the Christmas tree 85.

Figure 3:
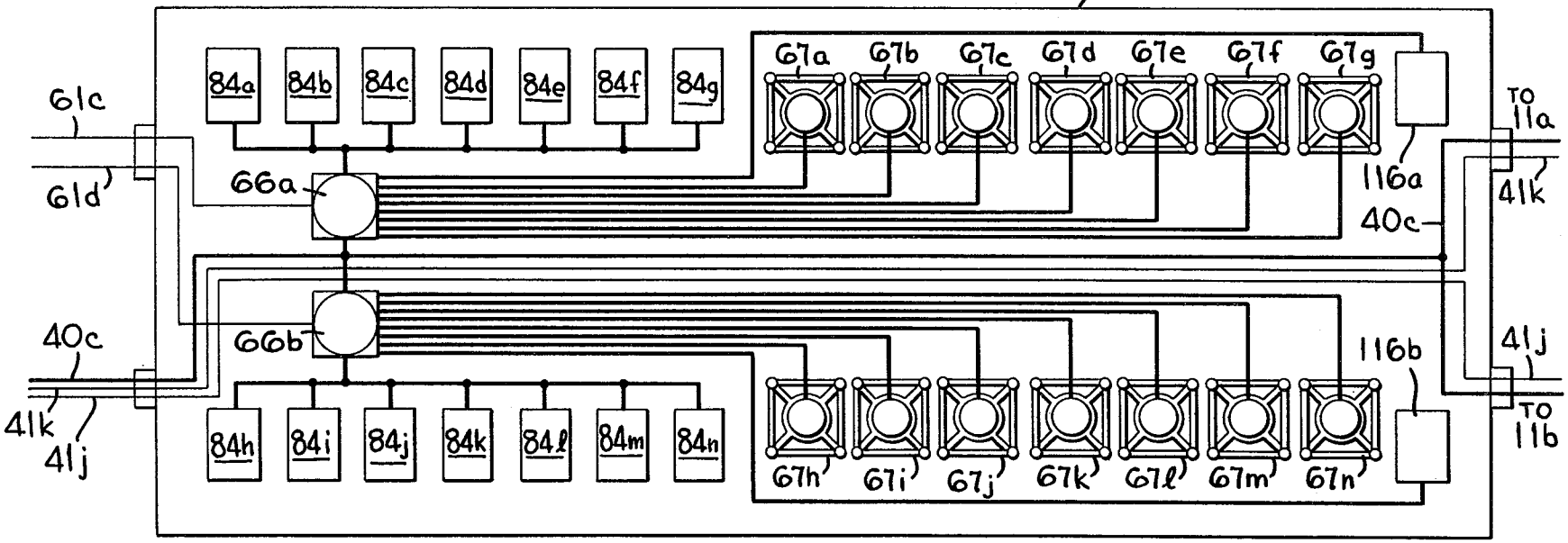
FIG. 3 is a diagrammatic view of a portion of the subsea well production system showing an enlarged view of one of the templates of FIG. 2.
Figure 4:
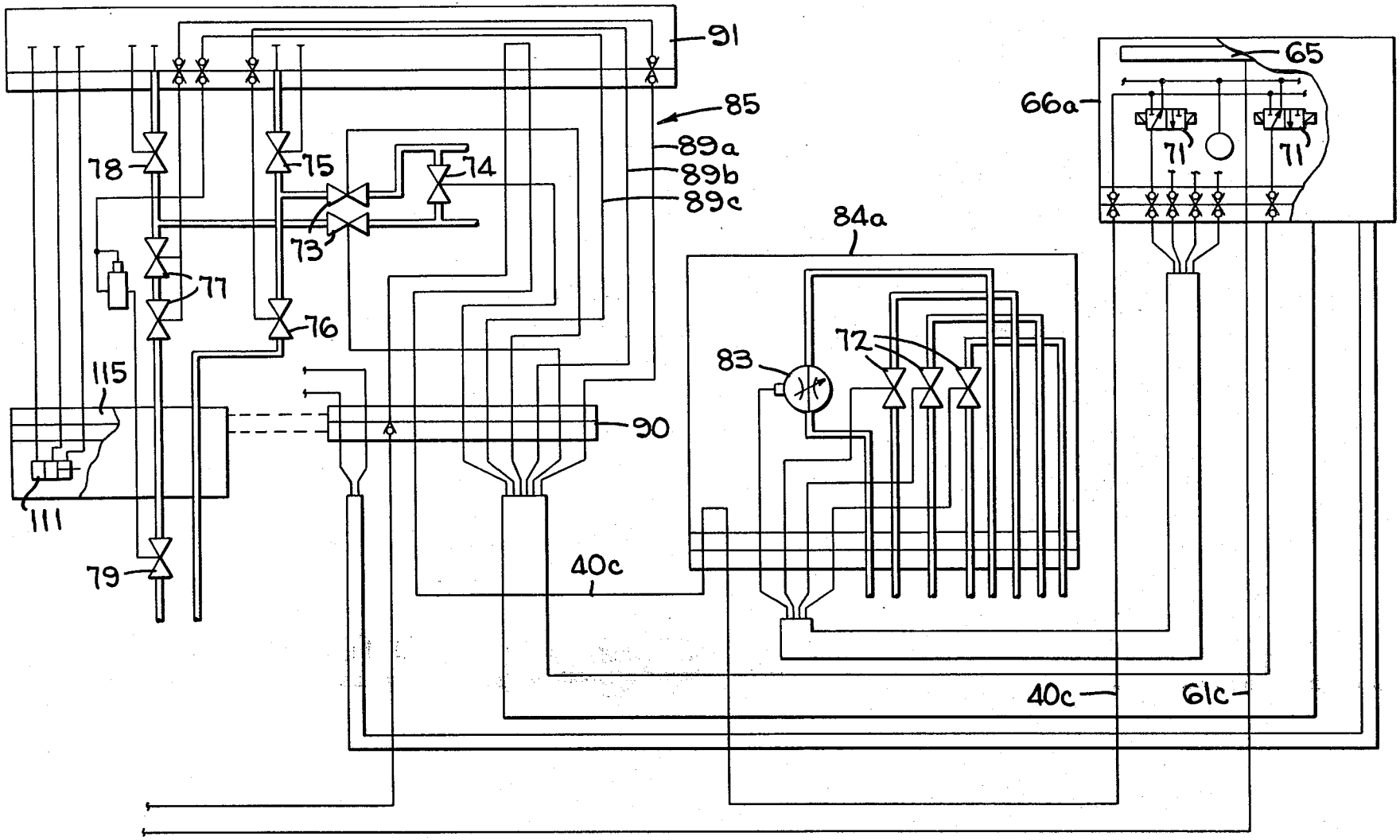
FIG. 4 is a schematic diagram of the control apparatus for a subsea Christmas tree of FIG. 3.
Figure 5:
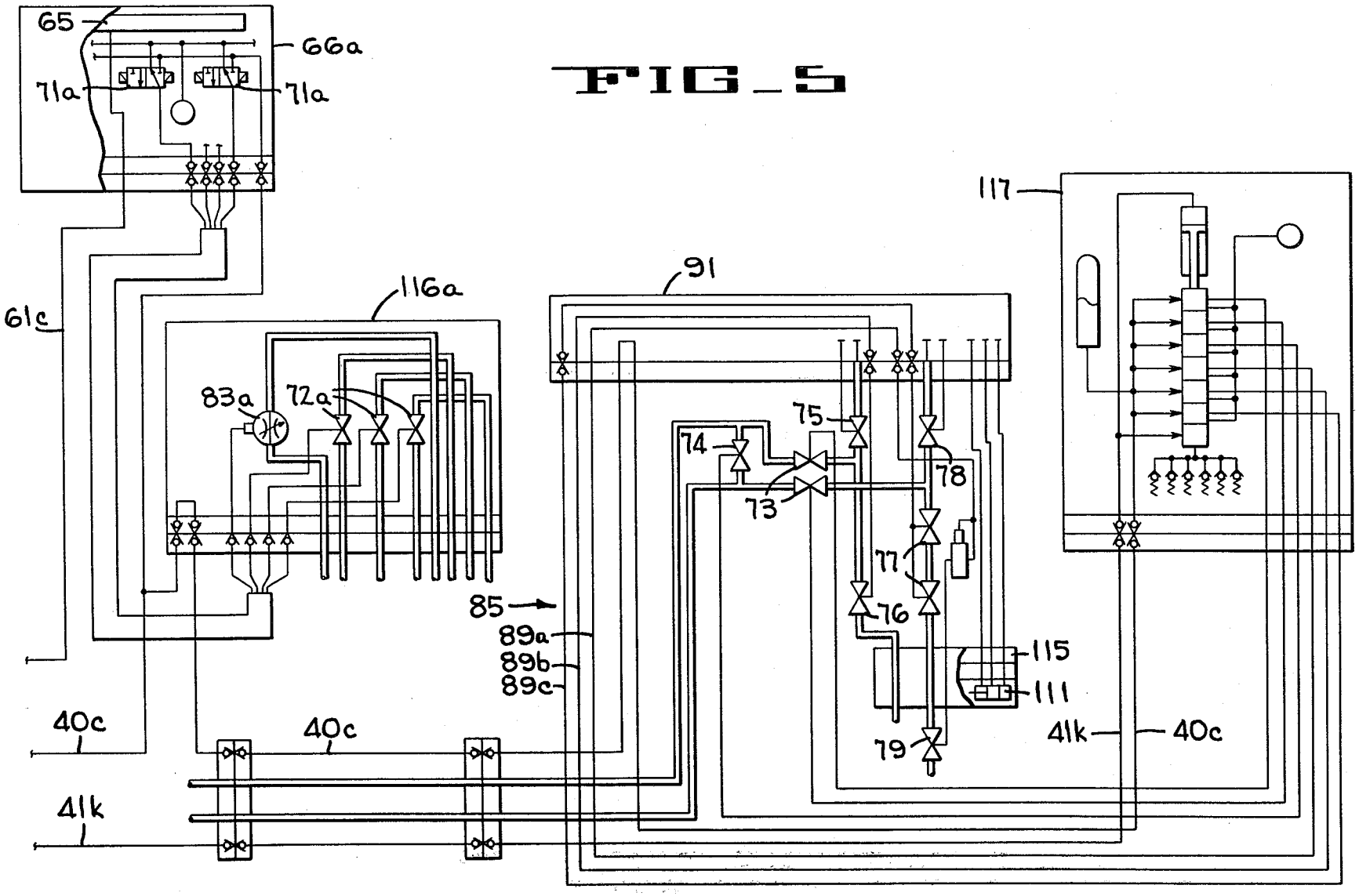
FIG. 5 is a schematic diagram of the control apparatus for a satellite tree of FIG. 2.

The electro-hydraulic control modules 66a–66h (FIGS. 1, 2) each control a corresponding one of a plurality of satellite manifolds 116a–116b (FIG. 3, only two are shown). The module 66a controls the manifold 116a, in addition to the manifold modules 84a–84g, and in a manner similar to the control exercised over manifold modules 84a–84g. The electronics portion 65 (FIG. 5) operates a plurality of spool valves 71a (only two are shown) and the spool valves provide hydraulic control of a plurality of valves 72a and a subsea choke 83a in the manifold module 116a.

The tree valves 76,77,79 (FIGS. 5, 6) in each of the satellite wells 11a–11h and 22a,22b are controlled by a matrix switching hydraulic control module 117 (FIGS. 5, 6) each having a single hydraulic control line 41a–41k (FIG. 1) and a single hydraulic supply line 40a,40b. Details of the matrix switching module 117 are most clearly shown in FIG. 6. The control module 117 includes a rotary actuator 120 connected to a rotary switch having a plurality of rotatable valve sections 121–127 each having a pressure input Pa-Pg, an output Oa-Og, and a vent Va-Vg. Each valve section includes a plurality of positions "a–f" each having either the pressure input connected to the output or having the output connected to the vent. Each of the pressure inputs Pa-Pg is connected to the hydraulic supply line 40g which is provided with pressurized fluid from the surface control center 29 (FIG. 2), and each of the vents Va-Vg is connected to a vent 129 which is vented to the sea. An accumulator 130, which is connected to the hydraulic line 140, aids in providing a stabilized value of hydraulic pressure to the valve sections 121–127. The actuator 120 is operated by a pilot valve 134. The rotary actuator 120 includes a rotatable shaft 120a which is coupled to a plurality of rotatable shafts 121a–127a of the valve sections 121–127.

Figure 6:
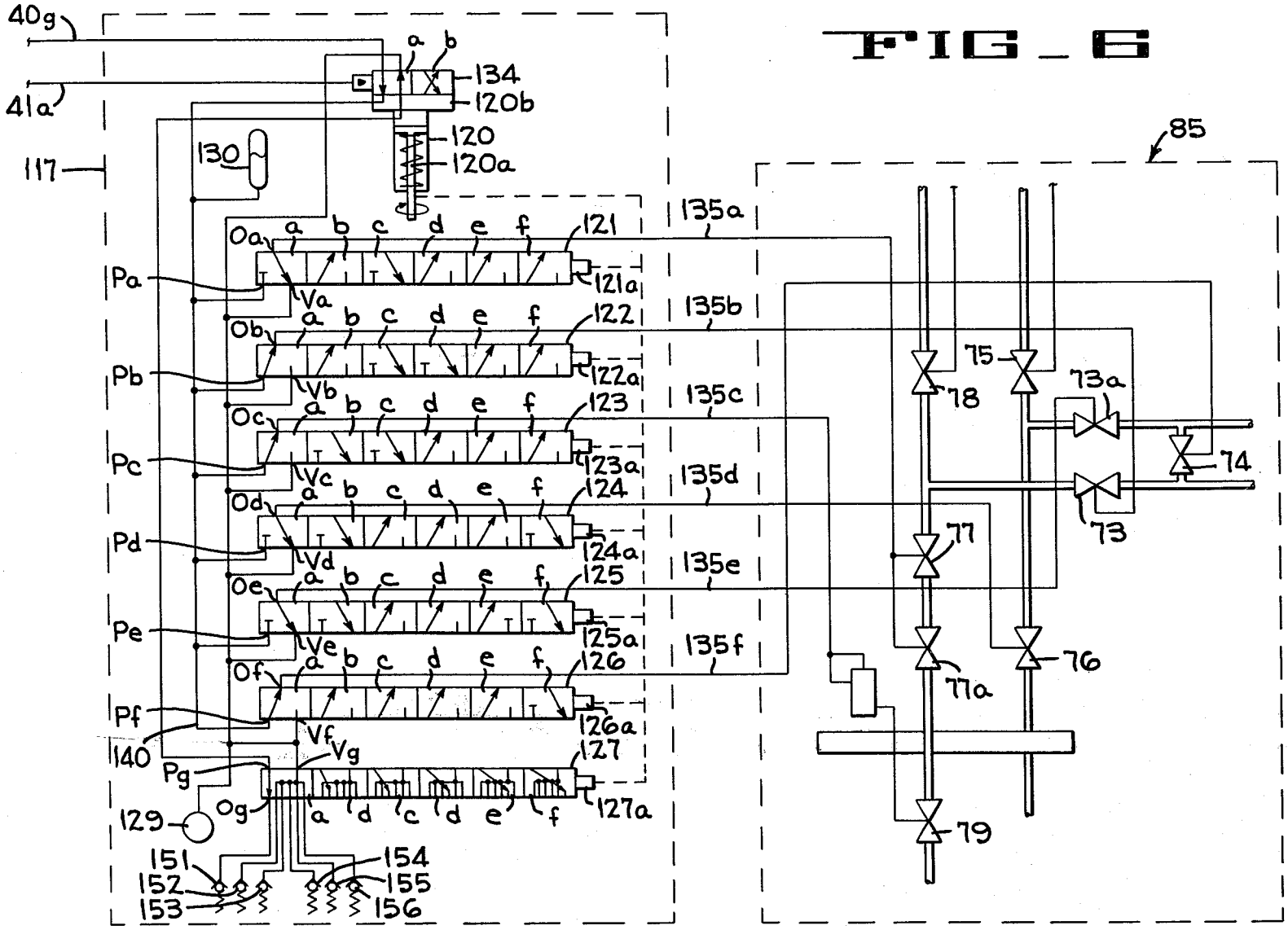
FIG. 6 is a schematic diagram of a switching control and valve circuitry which operates the subsea trees.

When a hydraulic pilot line 41a is unpressurized the pilot valve 134 is in the position shown in FIG. 6 wherein an upper chamber 120b of the actuator 120 is connected to the vent 129 through the valve sections "a", whereby the actuator shaft 120a and the valve section 121–127 remain in a stationary position. When pressure is admitted to the hydraulic pilot line 41a, the spool of the valve 134 shifts so that liquid from the hydraulic supply line 40*g* is coupled through the section "b" of the pilot valve 134 to the upper chamber 120*b*, causing the actuator 120 to rotate the valve sections 121–127 to another distinct position. When the valves 121–127 are in the positions shown in FIG. 6, hydraulic pressure from the hydraulic supply line 40*g* is coupled through the "a" portion of the hydraulic valve 122 through a hydraulic line 135*b* to a production wing valve 73 causing the wing valve to open. Hydraulic fluid coupled through "a" portion of the valve 123 and "a" portion of the valve 126 through hydraulic lines 135*c*, 135*f* also cause a downhole safety valve 79 and a crossover valve 74 to open. An upper master valve 77 and a lower master valve 77*a* are connected to vent 129 through hydraulic lines 135*a* and the "a" portion of the valve 121, and an annulus master valve 76 and an annulus wing valve 73*a* are connected to the vent 129 by lines 135*d*, 135*e* through the "a" portions of valve sections 124 and 125, respectively.

The lowermost valve 127 and a plurality of pressure relief valves 151–156 provide a predetermined upper value of pressure on the pilot line 41*a* at the control center to indicate the position of the valve 127, therefore also indicating the position of the rotary actuator 120 and of the other valves 121–126. For example, when all the valves are in their "a" positions, the pressure relief valve 151 is connected through "a" portion of the valve 127 to the pilot line 41*a* and limits the maximum pressure on the pilot line to 1000 psi. When all valves are in their "b" position, the pressure valve 152 limits the pressure on the pilot line 41*a* to 1400 psi, thereby indicating that the valves and the actuator are in said "b" positions. Further details of the matrix switching control module 117 can be found in a copending patent application "Matrix Switching Control of Subsea Production System" by the inventor of the present invention, Ser. No. 101,993, filed Dec. 7, 1979.

The present invention provides means for surface control of a plurality of subsea wells mounted on well templates and a plurality of satellite wells, using a significantly reduced number of electrical and hydraulic lines between a surface control unit and a riser base on the seafloor. An electrical cable between the riser base and the surface control unit provides electrical signals which control a plurality of electrohydraulic control modules on the well templates and on the riser. These control modules provide hydraulic control signals to the subsea wells and to the riser base. The electrohydraulic control modules are replaceable using surface operated running tools. A single hydraulic control line between each of the surface control unit and a corresponding one of the satellite well provides control of the operation of that well through a matrix switching circuit.

Although the best mode contemplated for carrying out the present invention has been herein shown and described, it will be apparent that modification and variation may be made without departing from what is regarded to be the subject matter of the invention.

What is claimed is:

1. A system for control of subsea template production systems for use with a surface control unit, a riser positioned in the open sea terminating at a riser base, a template remote from said riser base and having attached subsea trees, and a plurality of satellite wells having attached operators, said system comprising:

a power source coupled to said surface control unit;

a base control module mounted on said riser base;

means for coupling said base control module to said power source and to said surface control unit;

a plurality of template control modules mounted on said template;

means for coupling said surface control unit and said power source to said satellite wells to control said operators in said satellite wells;

means for coupling said surface control unit and said power source to said template control modules; and means for coupling said template control modules to said subsea trees for supplying control signals to said subsea trees from said template control modules.

2. A control system as defined in claim 1 wherein said power source includes an electrical power unit and a hydraulic power unit.

3. A control system as defined in claim 2 including means for coupling said electrical and said hydraulic power units to said base control module and to said template control modules, and means for coupling said satellite wells to said hydraulic power unit.

4. A control system as defined in claim 2 including means for connecting said hydraulic power unit to said satellite wells to provide hydraulic power and hydraulic control signals to operate said satellite wells.

5. A system for control of subsea template production systems for use with a surface control unit, a riser positioned in the open sea terminating at a riser base, at least one template remote from said riser base and having attached subsea trees, and a plurality of satellite wells having attached operators, said system comprising:

an electrical power unit connected to said surface control unit, to said riser base and to each of said templates;

a hydraulic power unit connected to said surface control unit;

an electrical distribution center mounted on said riser base;

means for connecting said electrical power unit to said distribution center and to said control unit;

means for connecting said hydraulic power unit to said riser base and to said control unit;

an electrohydraulic control module mounted on said riser base for controlling the operation of said riser base under the direction of said control unit and through said distribution center;

means for connecting said electrohydraulic control module to said distribution center;

means for coupling hydraulic power from said riser base to each of said satellite wells;

a plurality of hydraulic control lines; and means for coupling each of said hydraulic control lines between said control unit and a corresponding one of said satellite wells to control said operators in said satellite wells.

6. A control system as defined in claim 5 including:

an electrohydraulic template control module having an input for receiving electrical input signals and having a plurality of outputs, each of said outputs providing hydraulic output control signals in response to selected electrical input signals, said template control module being removably mounted on said template;

means for coupling said input of said template control module to said electrical distribution center; and means for coupling each of said template control module outputs to a corresponding one of said subsea trees.

7. A control system as defined in claim 5 including:

a plurality of electrohydraulic template control modules each having an input for receiving electrical input signals and having an output for providing hydraulic output control signals;

means for removably mounting said template control modules on said template;

means for coupling said input of each of said template control modules to said electrical distribution center;

means for coupling each of said outputs of said template control modules to a corresponding one of said attached subsea trees to control the operation of said subsea tree.

8. A system for control of subsea template production systems for use with a surface control unit, a riser positioned in the open sea terminating at a riser base on the seafloor, a template remote from said riser base and having attached subsea trees, and a plurality of satellite wells having attached operators, said system comprising:

an electrical power unit connected to said surface control unit;

a hydraulic power unit connected to said surface control unit;

a hydraulic supply line connected between said hydraulic power unit and said riser base;

an electrical distribution center mounted on said riser base;

means for connecting said electrical power unit to said electrical distribution center;

an electrohydraulic riser base control module mounted on said riser base and connected for controlling the operation of said riser base;

means for connecting said electrohydraulic riser base control module to said electrical distribution center;

an electrohydraulic template module mounted on said template for controlling the operation of said subsea trees;

means for connecting said template module to said electrical distribution center;

means for connecting said subsea trees, said satellite wells, said template module and said riser module to a lower end of said hydraulic supply line;

a plurality of hydraulic control lines; and means for coupling each of said hydraulic control lines between said control unit and a corresponding one of said satellite wells.

9. A control system as defined in claim 8 wherein each of said electrohydraulic control modules includes an input for receiving electrical input signals and a plurality of outputs, each of said outputs providing hydraulic output control signals in response to a predetermined electrical input signal.

10. A control system as defined in claim 9 wherein each of said electrohydraulic control modules is replaceable.

11. A method for remote individual control of subsea trees mounted on templates and subsea satellite wells using a smaller number of hydraulic lines between a surface control center and a subsea riser base, said riser base being remote from said templates and from said satellite wells, said method comprising the steps of:

(1) installing a source of pressurized hydraulic fluid and a source of electrical power at said surface control center, (2) installing an electrical distribution center and a hydraulic control module on said riser base, (3) connecting said electrical distribution center to said electrical source, (4) connecting said hydraulic control module to said hydraulic source, (5) connecting a surface control unit to said electrical and to said hydraulic sources;

(6) coupling said hydraulic source to said subsea trees and to said satellite wells, (7) coupling hydraulic control signals from said surface control unit to said satellite wells, and (8) coupling said electrical distribution center and said hydraulic source to said templates for controlling said subsea trees.

12. A method as defined in claim 11 including the further steps of:

(1) mounting an electrohydraulic multiplexed control module on each of said templates, (2) connecting each of said multiplexed modules to said subsea trees on said template, (3) coupling each of said multiplexed modules to said electrical distribution center and to said hydraulic source.

13. A method for remote individual control of subsea trees mounted on templates and subsea satellite wells using a smaller number of hydraulic lines between a surface control center and a subsea riser base, said riser base being remote from said templates and from said satellite wells, said method comprising the steps of:

(1) installing a source of pressurized hydraulic fluid and a source of electrical power at said surface control center, (2) installing an electrical distribution center and an electrohydraulic riser base control module on said riser base, (3) connecting said electrical distribution center to said electrical source, (4) connecting said electrohydraulic riser base control module to said hydraulic source, (5) connecting a surface control unit to said electrical and to said hydraulic sources, (6) mounting a plurality of electrohydraulic template control modules on said template, (7) connecting an electrical portion of said electrohydraulic riser base control module and said electrohydraulic template control modules to said distribution center, (8) connecting a hydraulic portion of each of said electrohydraulic template control modules to said subsea wells to control the operation of said subsea wells, (9) coupling hydraulic control signals from said surface control unit to each of said satellite wells, and

(10) coupling said pressurized hydraulic source to each of said satellite wells.

14. A method for remote individual control of subsea trees mounted on templates and subsea satellite wells using a smaller number of hydraulic lines between a surface control center and a subsea riser base, said riser base being remote from said templates and from said satellite wells, said method comprising the steps of:

(1) installing a source of pressurized hydraulic fluid and a source of electrical power at said surface control center, (2) installing an electrical distribution center and an electrohydraulic riser base control module on said riser base, (3) connecting a surface control unit to said electrical and said hydraulic sources, (4) connecting said electrical distribution center to said electrical source, (5) connecting a hydraulic supply line between said hydraulic source and said riser base, (6) connecting said electrohydraulic riser base control module to a lower end of said hydraulic supply line, (7) mounting an electrohydraulic template control module on said template, (8) connecting an electrical portion of said electrohydraulic riser base control module and said template control modules to said electrical distribution center, (9) connecting said template control module to said lower end of said hydraulic supply line,

(10) coupling a hydraulic portion of said template control module to each of said subsea trees,

(11) coupling a hydraulic control line between said control center and each of said satellite wells, and

(12) connecting each of said statellite wells and each of said subsea trees to said lower end of said hydraulic supply line.

15. A control system as defined in claim 1 wherein said satellite trees are remotely located from said riser base and from said template.

16. A control system as defined in claim 1 wherein said satellite trees are remotely located from said riser base, and including means for connecting said satellite trees to said riser base.

17. A control system as defined in claim 1 including means for connecting said base control module between said template control module and said surface control unit.

18. A control system as defined in claim 1 wherein said template control modules comprise electrohydraulic multiplex modules providing electrical control of hydraulic fluid to said subsea trees.

19. A system for control of subsea template production systems for use with a surface control unit, a riser positioned in the open sea terminating at a riser base, a template remote from said riser base and having attached subsea trees, and a plurality of satellite wells having attached operators, said system comprising:

a power source coupled to said surface control unit, a base control module mounted on said riser base, means for coupling said base control module to said power source and to said surface control unit, a plurality of template control modules mounted on said template, means for coupling said surface control unit and said power source to said satellite wells through said riser base to control said operators in said satellite wells, means for coupling said surface control unit and said power source through said remote riser base to said template control modules, and means for coupling said template control modules to said subsea trees for supplying control signals to said subsea trees from said template control modules.

20. A control system as defined in claim 19 wherein said power source includes an electrical power unit and a hydraulic power unit.

21. A control system as defined in claim 19 including means for coupling said electrical and said hydraulic power units to said base control module and to said template control modules, and means for coupling said satellite wells to said hydraulic power unit.

22. A control system as defined in claim 20 including means for connecting said hydraulic power unit to said satellite wells to provide hydraulic power and hydraulic control signals to operate said satellite wells.

23. A control system as defined in claim 5 including means for connecting said hydraulic power unit to said riser base through redundant supply lines and for connecting said hydraulic power unit to each of said remote templates and to each of said satellite wells, and wherein a path for hydraulic power extends from said power unit through said riser base and said template to said subsea wells.

24. A control system as defined in claim 5 including redundant hydraulic supply lines for connecting said hydraulic power unit to said riser base and to said control unit.

* * * * *